US005090129A

United States Patent [19]

Cunningham

[11] Patent Number: 5,090,129

[45] Date of Patent: Feb. 25, 1992

[54] CARPENTER SQUARE

[76] Inventor: Philip J. Cunningham, 54 Edenmills, West Hill, Ontario, Canada

[21] Appl. No.: 624,617

[22] Filed: Dec. 10, 1990

[51] Int. Cl.[5] ..... B43L 7/027

[52] U.S. Cl. ..... 33/481; 33/474; 33/476; 33/562

[58] Field of Search ..... 33/481, 474, 476, 479, 33/480, 482, 429, 451, 475, 565, 197, 520, 670, 42

[56] References Cited

U.S. PATENT DOCUMENTS

| | | | |
|---|---|---|---|
| 266,646 | 10/1882 | Rossman | 33/42 |
| 1,315,333 | 9/1919 | Roads | 33/476 |
| 1,995,204 | 3/1935 | Ford | 33/476 |
| 2,214,408 | 9/1940 | Arizpe | 33/474 |
| 2,764,818 | 10/1956 | Gard | 33/520 |
| 4,773,163 | 9/1988 | Wolford, Jr. | 33/474 |

FOREIGN PATENT DOCUMENTS

| | | | |
|---|---|---|---|
| 204300 | 11/1956 | Australia | 33/481 |
| 1163437 | 3/1984 | Canada . | |
| 2906921 | 9/1980 | Fed. Rep. of Germany | 33/481 |

*Primary Examiner*—William A. Cuchlinski, Jr.
*Assistant Examiner*—C. W. Fulton

[57] ABSTRACT

A carpenter's square is disclosed which is capable of simplifying common woodworking layouts by means of various ports and a reference point used to appropriately orientate the square. The square can also advantageously be used as a dividing tool for longitudinally dividing a piece of wood.

12 Claims, 6 Drawing Sheets

CARPENTER SQUARE

FIELD OF THE INVENTION

The present invention relates to woodworking tools and in particular to woodworking squares having multiple uses.

BACKGROUND OF THE INVENTION

Woodworking squares have been known for many years and normally include ruler portions angled at 90° to each other. A more useful carpenter's square is disclosed in Canadian Patent 1,163,437. This square has an overall shape corresponding to the present invention but is not capable of all of the functions of the carpenter's square of the present application.

Dividing tools are also known and disclosed in Canadian Patent 1,163,437 and are often used in association with squares.

SUMMARY OF THE INVENTION

A woodworking square, according to the present invention, comprises a planar body member having a straight aligning edge, a guide means associated with the straight aligning edge which extends perpendicularly from said planar body and is positioned to be colinear with the aligning edge. A straight first scribing edge is provided perpendicular to the aligning edge and a second straight scribing edge is disposed between the first scribing edge and the aligning edge. The second scribing edge intersects the junction point of the aligning edge and the first scribing edge. The planar body member includes a number of small circular apertures passing there through and the square includes a pin means sized to snuggly pass through any of the apertures to orientate the square in a particular manner relative to a straight edge in contact with the pin means and a reference point on the guide means or any other reference point.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
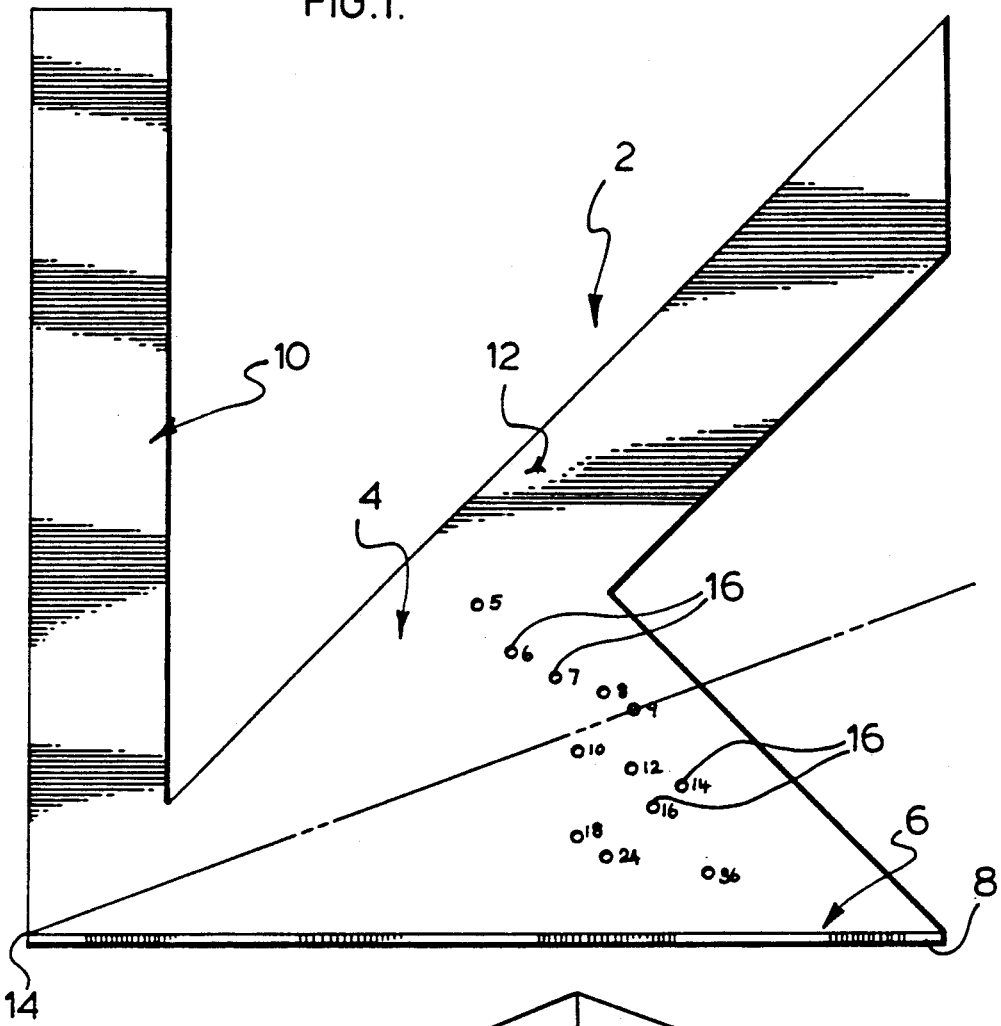
FIG. 1 is a side view of the carpenter square.

The woodworking square 2 has a planar body member 4, a straight aligning edge 6 having associated there-with a guide member 8. The guide member is perpendicular to the planar body member 4 and projects either side of the body member. The woodworking square also includes a first scribing edge 10 and a second scribing edge 12 which is angled at a 45° from the first scribing edge 10. The junction of the first scribing edge 10 and the guide member 8 forms a reference point 14 which is used as a pivot point when the square is used as a dividing tool. A number of reference or aligning ports 16 are provided in the planar body member 4 for receiving a pin and angling either the first scribing edge 10 or the second scribing edge 12 at particular angles for forming of various parts. For example, the reference points 16 are labelled with various numbers between 5 and 36 which correspond to two particular angles if both the first scribing edge 10 and the second scribing edge 12 are used. The following chart gives the angles, where 'A' represents the angle between scribing edge 10 and the normal to a line joining the reference point 14 and a pin placed in the corresponding hole of reference point 16, and 'B' represents the corresponding angle between the scribing edge 12 and the said normal:

| Hole No. | Degrees 'A' | Degrees 'B' | Distance to Base (inches) |
|---|---|---|---|
| 5 | 36° | 81° | 2¾* |
| 6 | 30° | 75° | 2⅜* |
| 7 | 25.7° | 70.7° | 2⅛ |
| 8 | 22.5° | 67.5° | 2 |
| 9 | 20° | 65° | 1⅞ |
| 10 | 18° | 63° | 1½ |
| 12 | 15° | 60° | 1⅜ |
| 14 | 12.8° | 57.8° | 1¼ |
| 16 | 11.25° | 56.25° | 1 |
| 18 | 10° | 55° | ¾ |
| 24 | 7.5° | 52.5° | ⅝ |
| 36 | 5° | 50° | ½ |

(*2¾ and 2⅜ also door lock layout holes)

This chart is preferably permanently attached or integral with the carpenter's square.

Figure 6:
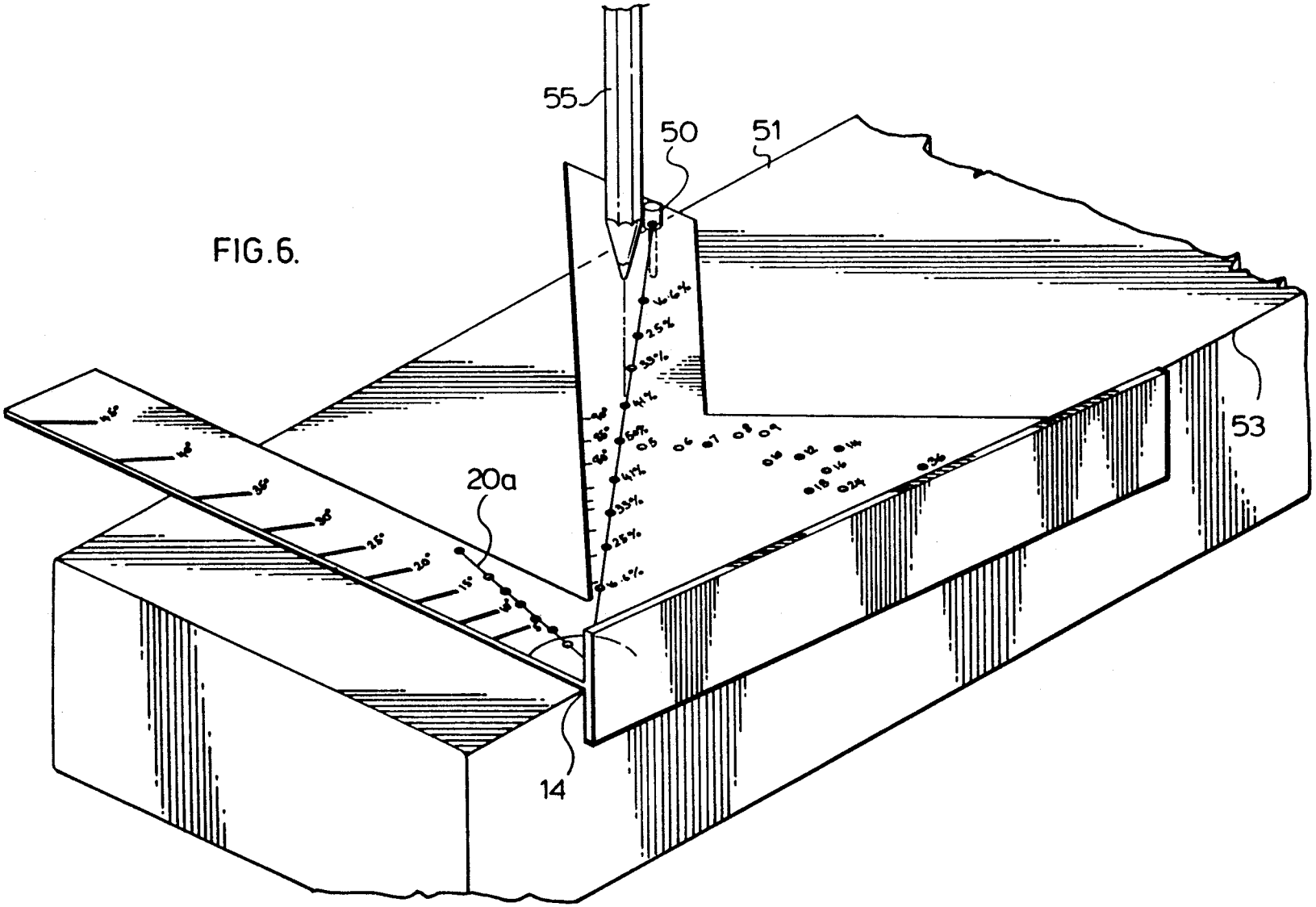
FIGS. 6, 7 and 8 are partial perspective views showing the square used for proper marking of a door to which a doorknob assembly is to be inserted.

It should also be noted that points 5 and 6 are particular distances from the guide means 8 and are used for appropriately marking a door for receiving a door opening assembly. Point 6 is 2-3/8 inches away from the guide member 8, whereas point 5 is 2¾ inches away from the guide member 8. These correspond to the center location of the point which is to be drilled for receiving of a door opening assembly. This will be further described with respect to FIGS. 6 through 8.

Figure 2:
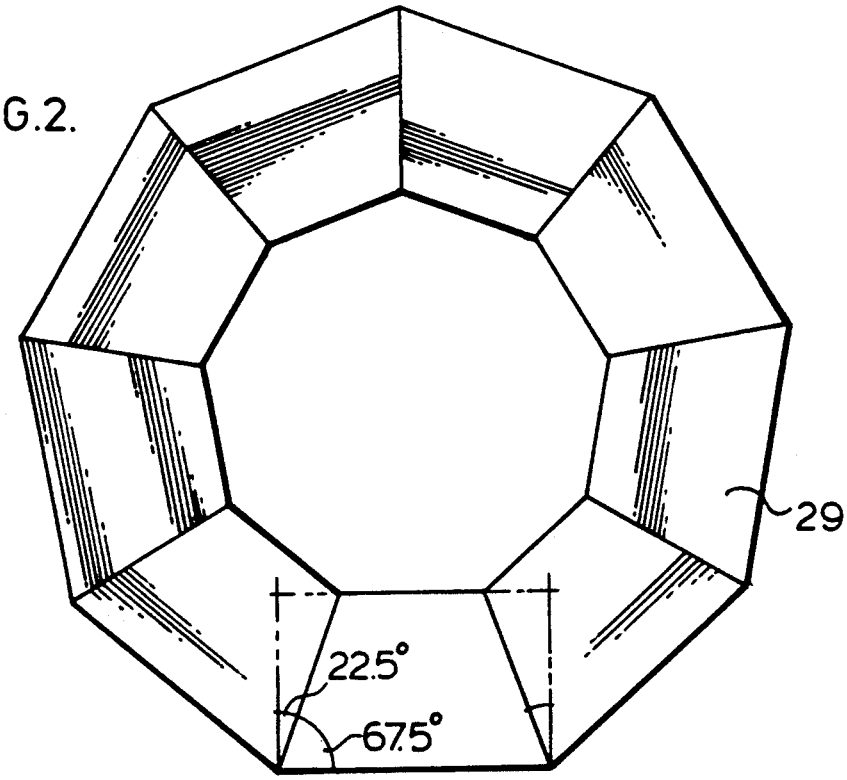
FIG. 2 is a top view of a nine-sided table have nine identical segments.

In FIG. 2, a nine-sided table 28 is shown having individual identical segments 29. The individual segments are formed by inserting a pin through reference point 9 and placing the reference point 14 against the piece of wood with the pin also against the wood whereby arm 10 is appropriately angled relative to the straight edge passing through reference point 14 and the pin placed in the 9 hole of the reference point 16. In this way, the individual segments can be quickly and easily formed without measuring, as the measurement has already been defined due to the particular placements of the reference points 16.

Figure 3:
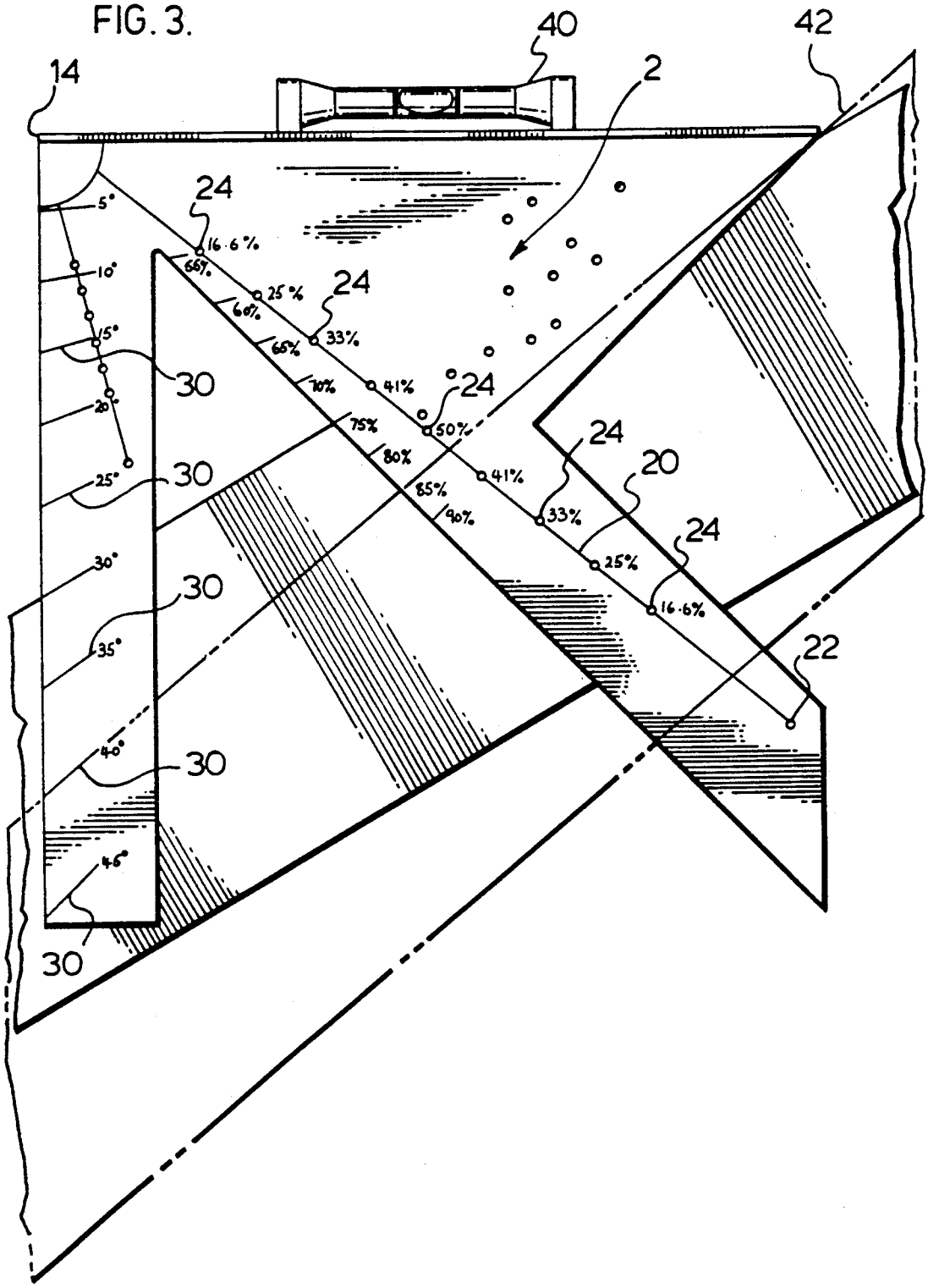
FIG. 3 is a view of the carpenter square showing the carpenter square in combination with a level for determining the angle of a rafter.

With respect to FIG. 3, it can be seen how the carpenter square 2 can be used in association with a level 40 placed on the flat edge of the guide member 8. The guide member 8 is brought into contact with the upper edge 42 of a rafter and the carpenter square is then adjusted or pivotted about this contact point until the level indicates a horizontal position of the guide member 8, whereafter the angle of the rafter can be determined from assessing the angle lines indicated as 30 provided on the first scribing edge 10. In this way, the carpenter square can be used for determining the angle of particular rafters for securing or for merely assessing at what angle they have been previously assembled. The carpenter square 2 can also be used as a dividing tool by means of the dividing line 20 which, in this case, is orientated to pass through the reference point 14 out to a pin receiving port 22. With a pin received in port 22, the carpenter square may be orientated such that the reference point 14 is in contact with one side of a straight edge of a piece of wood and the pin 22 is located against the opposite parallel edge of the piece of wood. A number of dividing points are provided along the line 20 and are shown as 24. Certain percentages are associated with each port which represent the dividing percentage across the piece of wood. This can perhaps be best understood with respect to FIG. 6 where it can be seen that the pin 50 is in contact with edge 51 of the piece of wood, whereas the reference point 14 is in contact with the opposite edge 53 of the piece of wood. In this case, the pencil 55 is about to be placed in the port 24 corresponding to a 41% division. If the carpenter square is then slid down the piece of wood with the pin 50 and reference point 14 remaining in contact with the edges 51 and 53, respectively, a vertical line will appear parallel to edges 51 and 53, dividing the width of the board into a first area corresponding to 41% of the area and an area beyond the line corresponding to 59% of the area. It has been found that this 41% division is particularly valuable for wood joints. In the case where the wood is extremely narrow and thus the carpenter square would be placed at a very extreme angle relative to the piece of wood, a smaller dividing line 20A is shown which can be used in a similar manner.

Figure 4:
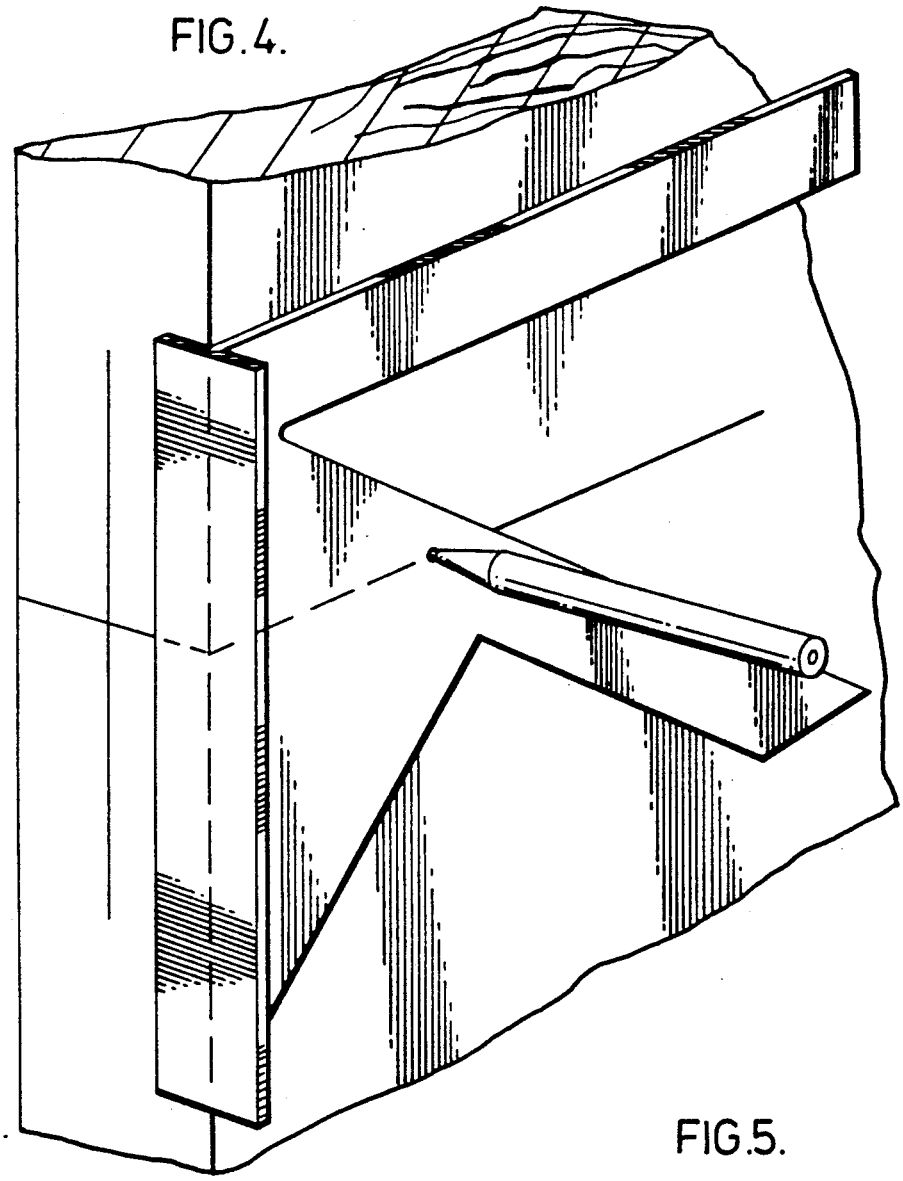
FIG. 4 is a perspective view of the carpenter square used to mark a door to which a door assembly is to be inserted.
Figure 5:
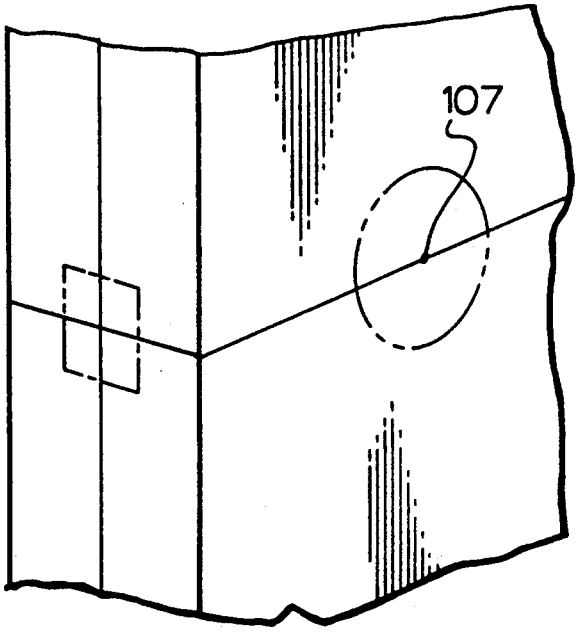
FIG. 5 is a partial perspective view of the door showing the edge point to which the plunger assembly of the door is to be inserted as well as the port within the face of the door for receiving the doorknob assembly.
Figure 7:
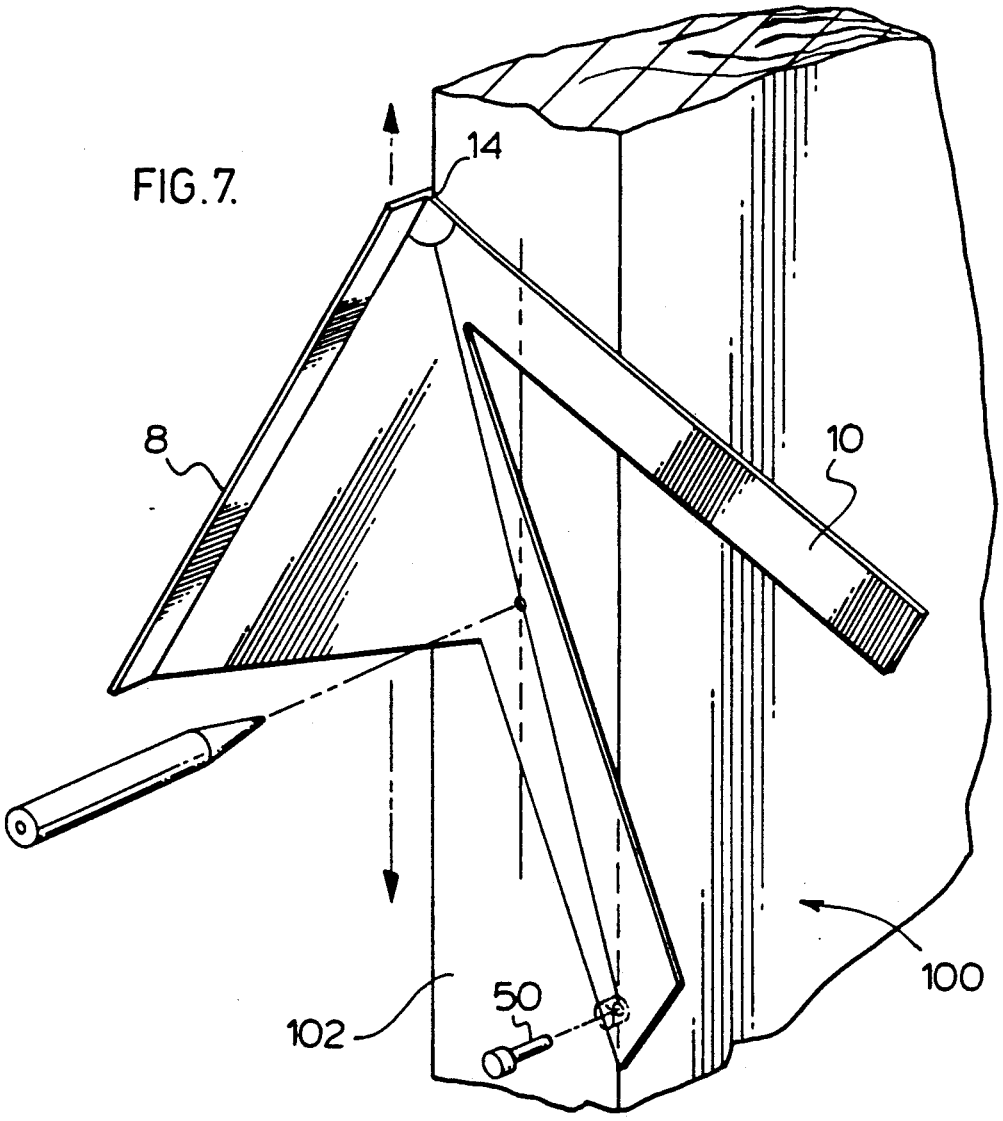
Figure 8:
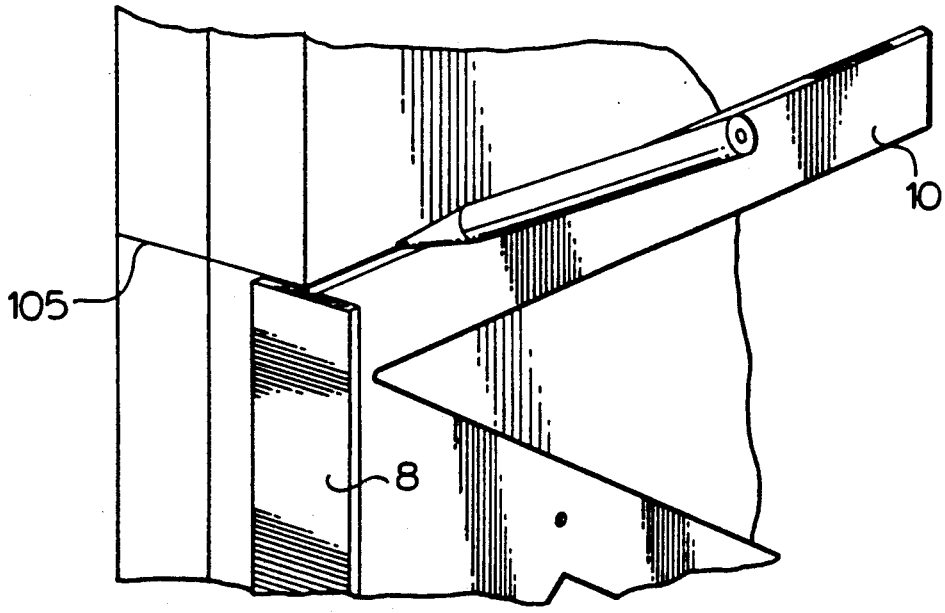
Figure 9:
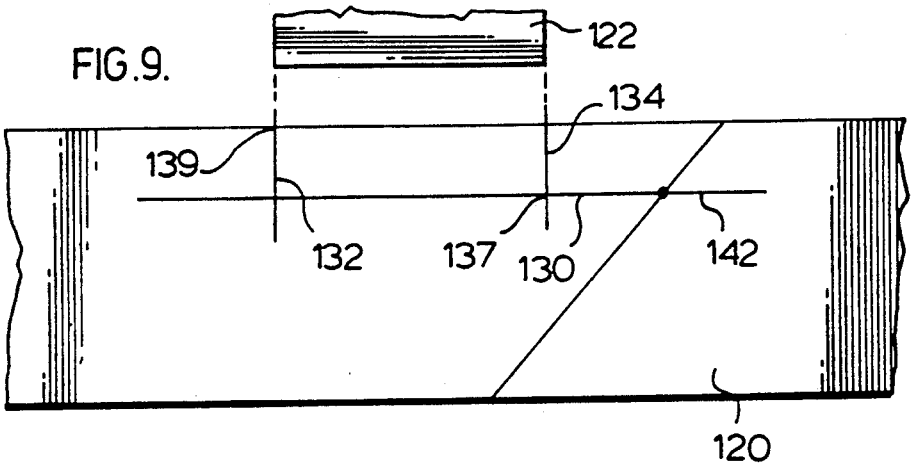
FIGS. 9, 10 and 11 show the square used to properly notch a straight beam for the forming of a wood joint.
Figure 10:
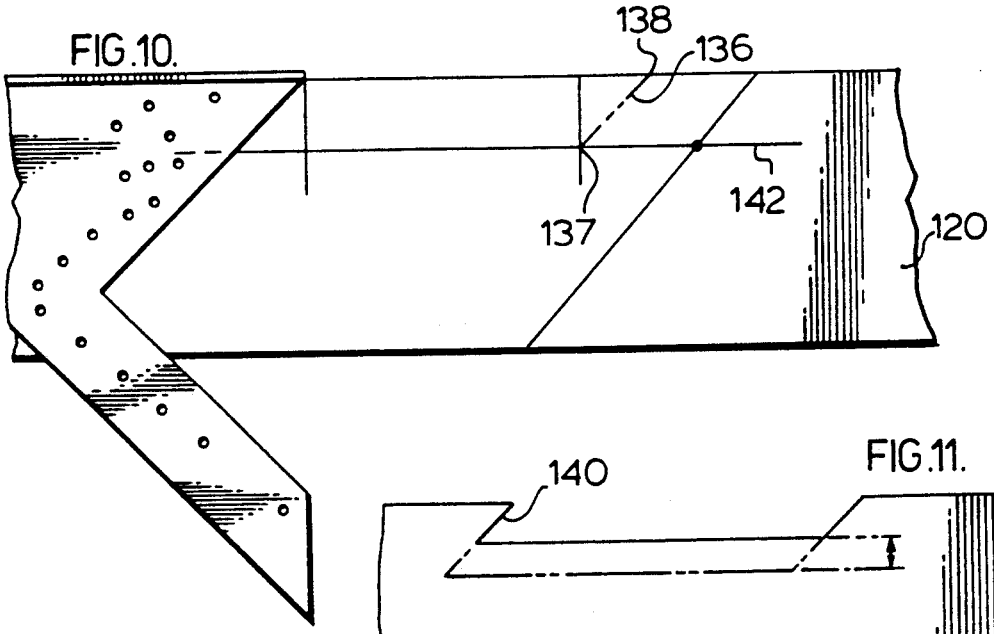
Figure 11:
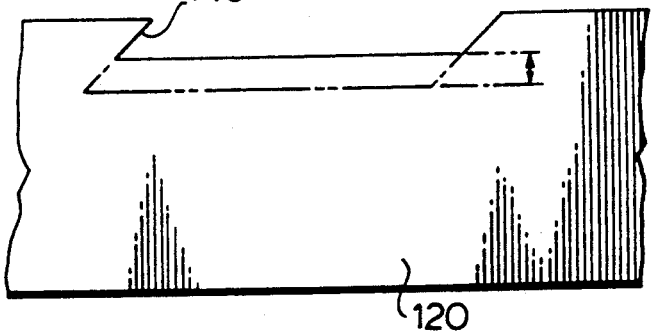

FIGS. 7 and 8 indicate the procedure for marking of a door. The door, generally shown as 100, has an edge 102 which will receive the door closing mechanism. The dividing line 20 is used and the 50% location of the dividing ports 24 are used to provide the center line of the door. This is possible, as pin 50 is in contact with one edge of the door and reference point 14 is in contact with the opposite edge. Once the line has been drawn, then an appropriate horizontal line is drawn by bringing the guide member 8 into contact with the edge of the door to allow scribing edge 10 to form the horizontal line 105 at the appropriate location from the ground. Once line 105 has been inserted, the square is then moved to the position shown in FIG. 8 and the scribing edge 10 is properly located by the guide member 8 in contact with the edge of the door to mark a horizontal line across the width of the door. The ports 5 or 6 may then be used to properly mark the appropriate distance in from the edge of the door for receiving the door turning mechanism. This can best be appreciated from a review of FIGS. 4 and 5 where the appropriate point 107 has been marked. Thus, the square provides a very simple mechanism for properly marking of a door for receiving of a door opening and closing assembly.

Figure 12:
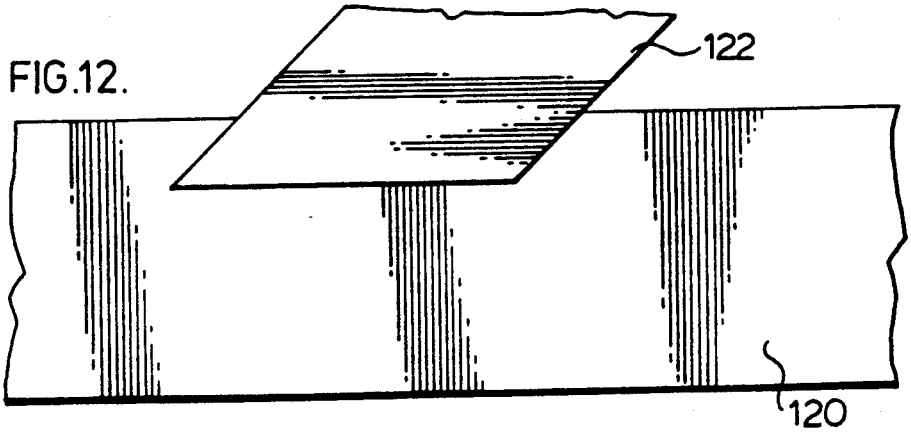
FIG. 12 shows the final joint.

FIGS. 9 through 12 show the particular layout for notching of a piece of wood for receiving a like piece of wood at a 45° angle. The final joint is generally shown in FIG. 12. The notch that will be necessary in wood piece 120 does not correspond to the width of the other member 122, as member 122 is disposed at a 45° angle. To appropriately mark piece 120 for receiving member 122 at the 45° angle, several steps are taken. The first step is to mark the piece 120 with the line indicating a 41% division of the piece of wood, with this line generally shown as 130 in FIG. 9. The component 122 is then brought into an abutment type position with member 120 such that its width can be marked on the member to form lines 132 and 134. A 45° angle is then formed by having the angle pass through point 137 indicated in FIG. 9. 137 represents the junction of the normal width of member 122 and the 41% line. It is then necessary to draw a 45° through the point 139, which is the junction of the face of member 120 and the width of member 122. This line is generally shown as 140 in FIG. 11. The 45° line passing through junction 137 and extending to the edge of member 120 is shown as 136 in FIG. 10. This is then the appropriate angle for cutting out the notch in member 120. The depth of the notch will vary according to the individual's preference. This will result in the joint between component 120 and component 122 shown in FIG. 12 which is a 45° angle relative to the axis of the members. For a 30° angle between the members, the 16.6% line is used for forming of the reference line 142 in FIG. 9 which corresponded to the 41% line. The same step is provided for identifying the point where line 136 intersects the outer edge of component 120, however, rather than cutting along this line, a 30° angle is then drawn back from point 138 in FIG. 10 rather than the 45° line for forming of the segment of 140 in FIG. 11. The 30° line may be easily drawn by means of a pin being placed in the circular port labelled 6 of the reference apertures 16, as can be seen from the earlier table.

It can be seen from the above that the present carpenter's tool can be used for dividing of particular components for use in laying out door assemblies or merely dividing a piece of wood, as required; for determining the angle of rafters, for example, when it is used in combination with a small level; for angling either the first scribing edge 10 or the second scribing edge 12 at a particular angle relative to the straight line by means of a pin member passing through particular placed ports; and for laying out of door opening assemblies.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A woodworking square comprising a planar body member having a straight aligning edge, a guide means associated with said straight aligning edge and extending perpendicularly from said planar body and positioned to be colinear with said aligning edge, a straight first scribing edge perpendicular to said aligning edge and a second straight scribing edge disposed between said first scribing edge and said aligning edge and said first edge, and wherein said second scribing edge intersects the junction point of said aligning edge and said scribing edge and wherein said planar body member includes a number of small apertures passing there through and said square includes a pin means sized to snuggly pass through any of said apertures and orientate said square in a particular manner relative to a straight edge of a piece of material in contact with said pin means and a reference point on said guide means.

2. A woodworking square as claimed in claim 1 wherein said reference point on said guide means is at the junction of said guide means and the upper edge of said first scribing edge.

3. A woodworking square as claimed in claim 2 wherein said first scribing edge and said second scribing edge include a plurality of angle measurements thereon.

4. A woodworking square as claimed in claim 1 wherein the junction of the upper edge of said first scribing edge and said straight aligning edge form a pivot edge which extends generally perpendicular to said planar body, and wherein said first scribing edge and said second scribing edge include a plurality of angle measurements thereon which in combination with said pivot edge allow measurement of angles from the vertical.

5. A woodworking square as claimed in claim 1 wherein the junction of the upper edge of said first scribing edge and said straight aligning edge define said reference point and a pivot edge which extends generally perpendicular to said planar body.

6. A woodworking square as claimed in claim 5 wherein at least some of said small apertures are located to effect division of a piece of straight sided wood by placing said pivot edge against one side of the wood, locating said pin in a particular small aperture and bring said pin into contact with the opposite straight edge of said wood whereby certain small apertures are located between said sides a given percentage of the distance between said sides.

7. In combination a woodworking square as claimed in claim 4 and a level mountable on said straight aligning edge for indicating when said edge is level.

8. A woodworking square as claimed in claim 6 wherein said small apertures used for dividing of a piece of wood are located in said second scribing edge.

9. A woodworking square as claimed in claim 8 including a second series of small apertures associated with said first scribing edge and a particular small aperture for receiving said pin to effect division of a piece of wood having straight sides.

10. A woodworking square as claimed in claim 5 wherein a plurality of apertures are placed in said planar body below said second scribing edge located to orientate said first scribing edge and said second scribing edge at particular angles relative to a straight edge of a piece of wood when said square overlies the wood and said pivotal edge and said pin means, placed in one of said holes, are in contact with said straight edge.

11. A woodworking square as claimed in claim 10 wherein said guide means is a rectangular section.

12. A woodworking square as claimed in claim 1 wherein said apertures and said pin means cooperate and allow said woodworking square to define predetermined angles, allow predetermined longitudinal division of a longitudinal area of a piece of wood, and allow specialized measurements for wood joints; and wherein said apertures and said pin means in combination with a level allow measurement of angles from the horizontal.

* * * * *